US005722213A

United States Patent [19]

Morency

[11] Patent Number: 5,722,213

[45] Date of Patent: Mar. 3, 1998

[54] FIRE RESISTANT STEEL DOOR WITH DROP-IN CORE

[75] Inventor: Steven M. Morency, New Albany, Ind.

[73] Assignee: Ideal Architectural Doors & Plywood, New Albany, Ind.

[21] Appl. No.: 713,605

[22] Filed: Sep. 13, 1996

Related U.S. Application Data

[63] Continuation-in-part of Ser. No. 539,190, Oct. 4, 1995, abandoned.

[51] Int. Cl.[6] ..... E06B 5/16

[52] U.S. Cl. ..... 52/784.11; 52/784.1; 52/784.15; 52/784.16; 52/794.1; 52/795.1; 52/797.1; 52/742.12; 52/745.15; 106/18.12; 106/600; 427/397.8

[58] Field of Search ..... 52/455, 784.1, 52/784.11, 784.15, 784.16, 794.1, 795.1, 797.1, 802.1, 802.11, 390.1, 390.13, 390.14, 390.15, 783.1, 742.12, 745.15, 745.16; 106/18.11, 18.12, 600, 605; 427/397.8

[56] References Cited

U.S. PATENT DOCUMENTS

| | | | |
|---|---|---|---|
| 1,183,586 | 5/1916 | Olberg et al. | 52/794.1 X |
| 1,782,794 | 11/1930 | Sadwith | 52/794.1 X |
| 1,793,382 | 2/1931 | Woehler | 52/784.16 |
| 2,451,396 | 10/1948 | Macleod | 52/455 |
| 2,579,157 | 12/1951 | Price, Sr. et al. | 52/794.1 X |
| 3,004,641 | 10/1961 | Johnson | 52/455 |
| 3,455,078 | 7/1969 | Brown et al. | 52/794.1 X |
| 3,566,564 | 3/1971 | Gaeth et al. | 52/784.11 X |
| 4,104,828 | 8/1978 | Naslund et al. | 52/784.11 X |
| 4,179,535 | 12/1979 | Kalbskopf et al. | 427/397.8 X |
| 4,270,326 | 6/1981 | Holter et al. | 52/784.11 |
| 4,288,253 | 9/1981 | Venable | 106/605 |
| 4,489,121 | 12/1984 | Luckanuck | 428/192 |
| 4,746,555 | 5/1988 | Luckanuck | 106/18.12 X |
| 4,769,196 | 9/1988 | Schofield et al. | 106/18.12 X |
| 4,799,349 | 1/1989 | Luckanuck | 52/784.11 |
| 5,045,385 | 9/1991 | Luckanuck | 52/784.11 X |
| 5,085,897 | 2/1992 | Luckanuck | 427/397.8 X |
| 5,284,700 | 2/1994 | Strauss | 428/240 |
| 5,603,194 | 2/1997 | Fridlyand et al. | 52/515 |

FOREIGN PATENT DOCUMENTS

| | | | |
|---|---|---|---|
| 644931 | 10/1928 | France | 52/455 |
| 2652109 | 3/1991 | France | 52/794.1 |
| 56-31315 | 7/1981 | Japan | 427/397.8 |
| 5-248592 | 9/1993 | Japan | 52/794.1 |
| 630237 | 10/1949 | United Kingdom | 52/784.1 |
| 1479983 | 7/1977 | United Kingdom | 52/784.16 |

*Primary Examiner*—Wynn E. Wood
*Assistant Examiner*—Laura A. Callo
*Attorney, Agent, or Firm*—Wheat, Camoriano, Smith & Beres, PLC

[57] ABSTRACT

A heat temperature rise door is made up of a steel shell and a core which is not bonded to the steel shell, thus eliminating much of the cost of manufacture of the door.

4 Claims, 1 Drawing Sheet

FIRE RESISTANT STEEL DOOR WITH DROP-IN CORE

This is a continuation-in-part of U.S. patent application Ser. No. 08/539,190, filed Oct. 4, 1995, now abandoned.

BACKGROUND OF THE INVENTION

The present invention relates to fire resistant doors. Various types of fire resistant doors are known. In the United States, there are doors which are rated based on the amount of time it takes for a fire to burn through the door. There are also doors known as heat temperature rise doors. The heat temperature rise doors meet a higher standard, so that, when there is a fire on one side of the door, the temperature on the other side of the door remains below a certain level for a certain period of time.

Heat temperature rise doors are made using a steel shell and bonding insulation to the inner surfaces of the steel shell. The most commonly-known heat temperature rise door in the United States is made with a gypsum core bonded to the steel shell. However, it is also known to bond a mineral fiber core to the steel shell, as taught by U.S. Pat. No. 4,799,349 "Luckanuck", which is hereby incorporated by reference.

Assembling these heat temperature rise doors is time, energy, and labor intensive, because it includes troweling a glue or bonding agent onto two surfaces (usually the inside surface of one of the steel sheets and one surface of the core) and then heating and pressing the shell and core together to cure the glue. The hot press which is used in this process is itself a relatively expensive item.

In the case of the door taught by Luckanuck, the core is first coated with a material which dries to form a ceramic coating. Then, the core is bonded to the steel shell, which requires a heating and curing process. Then, the shell parts are welded together. Then, if the door is exposed to the high temperatures of a fire, the ceramic coating intumesces, protecting the core. When the coating intumesces, it expands and creates an insulating layer, which protects the core, thereby protecting the door.

SUMMARY OF TEE INVENTION

The present invention improves over the prior art by eliminating the time and expense of bonding the core to the steel shell while still meeting the U.S. standards for a heat temperature rise door.

The present invention provides a core which can simply be dropped into the shell without bonding to the steel shell. This saves a substantial amount of time in the manufacturing process and eliminates the need for a hot press, which is a relatively expensive piece of equipment.

While the Luckanuck patent stresses the importance and necessity of bonding the core to the steel shell, the present invention goes against that teaching of the prior art by eliminating the bonding of the core to the shell and still obtaining a door which meets U.S. standards for a temperature rise door.

BRIEF DESCRIPTION OF TEE DRAWINGS

DESCRIPTION OF THE PREFERRED EMBODIMENT

Figure 1:
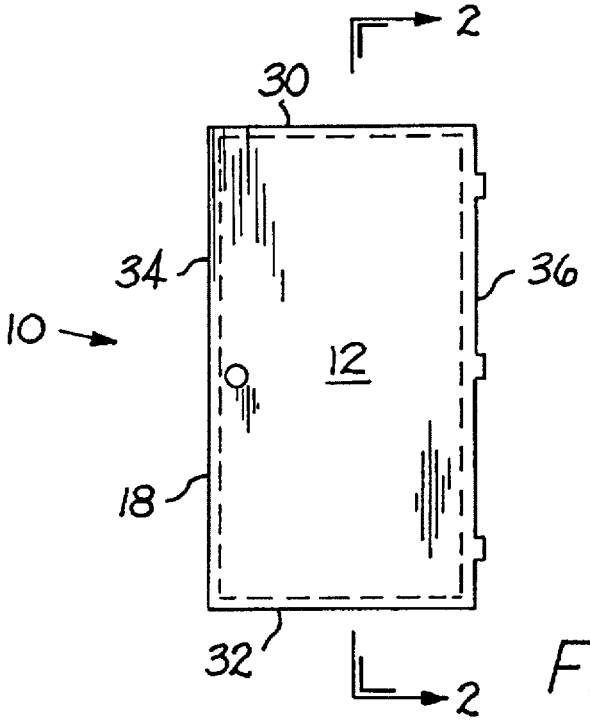
FIG. 1 is a front view of a door made in accordance with the present invention.
Figure 2:
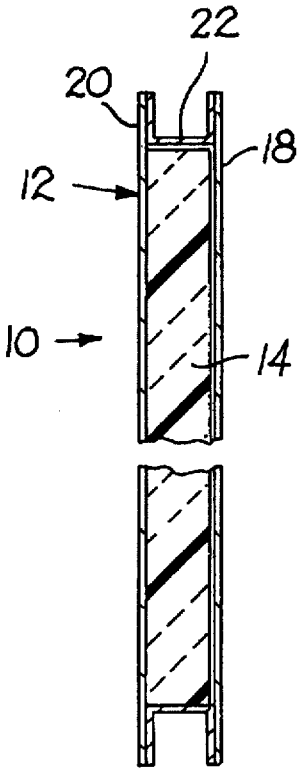
FIG. 2 is a view taken along the section 2—2 of FIG. 1, partially broken away.
Figure 3:
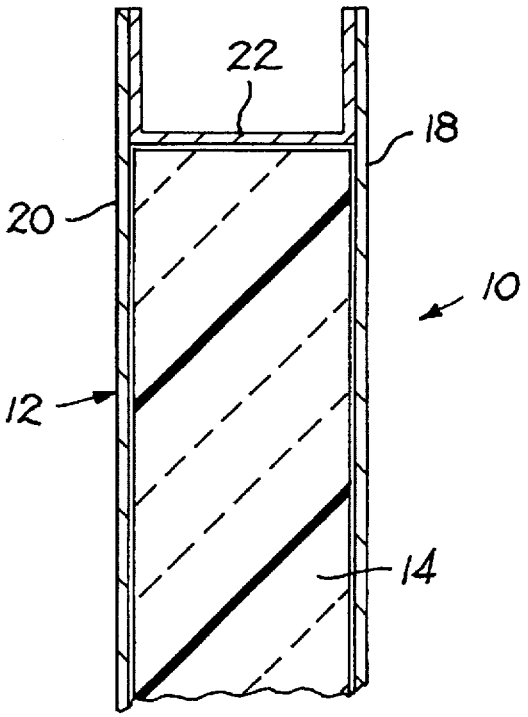
FIG. 3 is an enlarged view of the top portion of FIG. 2.

Referring to FIGS. 1–3, the preferred embodiment of the present invention is a door 10, which is made up of a steel shell 12 and an insulating core 14 inside the shell 12.

The steel shell 12 includes front and back flat steel sheets 18, 20, respectively, and U-shaped channels 22 welded between the sheets 18, 20, at the top 30, bottom 32, left 34 and right 36 sides of the sheets 18, 20 to form a closed steel shell.

The insulating core of the present invention is preferably made in accordance with the teaching of U.S. Pat. No. 4,799,349 "Luckanuck". As is taught in the "Luckanuck" patent, the core is made from a high density bonded mineral fiber sheet which has dimensions that substantially fill the space between the steel sheets 18, 20. The bonded mineral fiber sheet preferably has a phenolic resin content of 4–10% by weight, used to bind the fibers together, and the fibers are mostly made up of silica and calcium oxide.

Once the bonded mineral fiber sheet is cut to size, it is coated with a ceramic coating. Again, in accordance with the teaching of the Luckanuck patent, the coating is made from a liquid mixture of a metal silicate, preferably sodium or potassium silicate, and more preferably sodium silicate, with a mineral powder. This coating is dried, either by heating or by air drying, to form a ceramic coating on the mineral fiber sheet. It is preferable to air dry, as this avoids the need for heating. If this coated fiber sheet is later subjected to high temperatures, such as in the event of a fire, the ceramic coating intumesces, protecting the coated fiber sheet. The Luckanuck patent teaches a variety of materials that can be used to form the ceramic coating.

The shell 12 is partially built by continuously welding the channel 22 to the perimeter (top 30, bottom 32, left 34 and right 36 sides) of the back door panel 20 to form a rectangular-shaped trough. Then, the ceramic-coated core 14 is placed into the trough. Then, the front door panel 18 is placed on top of the core 14 and is continuously welded to the channel 22 along its perimeter (top 30, bottom 32, left 34 and right 36 sides) to sandwich the core 14 between the sheets 18, 20 and to form a closed steel shell 12 with an independent insulated core 14 inside.

This assembly differs from the assembly taught by Luckanuck in an important aspect. In the present invention, the core 14 is not glued or bonded to the steel shell 12. The core 14 remains an independent member from the shell 12. Thus, in the present invention, it is not necessary to trowel on a glue or binder over two full surfaces, and it is not necessary to hot press the shell and core together to bind them together. This saves about one hour in the process of making a door, which is a very substantial cost savings.

EXAMPLE

A sheet of 1⅝-inch thick insulating sheet sold under the brand name "Door Board", by Partek Insulation Inc., was coated with a liquid mixture of 60% by volume sodium silicate and 40% by volume Nyad G. It was air dried until the liquid mixture formed a ceramic coating on the insulating sheet. The coated insulating sheet was then dropped into a steel door shell, and the shell was welded closed, as was described above. This formed a 1⅝-inch thick 48 by 58 inch high temperature rise steel door.

The door was then fire tested. During the fire test, no attempt was made to restrain the expansion and deformation of the sample, no load was applied to the sample, and no deflection measurements were made of the sample. The furnace temperatures followed the time temperature curve as defined in the Standard for Fire Tests of Door Assemblies UL 10B, which is hereby incorporated by reference. At 30 minutes, the temperature rise on the unexposed surface was 205.5° F. There was no flaming on the unexposed surface of the door. The door was found to comply with the requirements of UL 10B, so the door is eligible for use on swinging type fire doors rated up to and including 3 hours.

Thus, the present invention provides a door which meets the required standards while eliminating a large portion of the assembly that is taught by the prior art. By not bonding the insulating core to the shell, the present invention reduces the assembly time by about one hour and eliminates the cost of a heat press as well as the energy costs of operating a heat press. If the heat press was generally the bottleneck in the manufacturing process, which often is the case, that bottleneck is eliminated by the present invention by totally eliminating the need for the heat press.

It will be obvious to those skilled in the art that modifications may be made to the embodiment described above without departing from the scope of the present invention.

What is claimed is:

1. A heat temperature rise door, comprising:

a steel shell;

an insulating core inside said shell, said insulating core comprising a bonded mineral fiber sheet which is not bonded to the steel shell; and a ceramic coating over said bonded mineral fiber sheet; wherein said ceramic coating is made from a liquid alkali metal silicate mixed with a mineral powder which is dried to form said ceramic coating and which, if it is subjected to high temperatures, will intumesce.

2. A heat temperature rise door as recited in claim 1, wherein the mineral fibers of said core are made mostly of silica and calcium oxide.

3. A method for making a heat temperature rise door, comprising the steps of:

coating a bonded mineral fiber sheet with a mixture of liquid alkali metal silicate and mineral powder;

drying said coating to form a ceramic coating on said bonded mineral fiber sheet;

sandwiching said coated bonded mineral fiber sheet between two steel door panels to form a core between said door panels; and welding around said door panels to form a closed, steel door shell, wherein the core is inside the shell and is not bonded to the shell, and wherein, if said door is subjected to high temperatures, said ceramic coating will intumesce.

4. A heat temperature rise door, consisting of:

a bonded mineral fiber sheet;

a ceramic coating on said sheet formed from a mixture of liquid alkali metal silicate and mineral powder which has been coated on the mineral fiber sheet and has been dried to form said ceramic coating; and a steel shell around said bonded, coated mineral fiber sheet, wherein said steel shell and bonded mineral fiber sheet are independent members, not bonded together, and wherein, if said door is subjected to high temperatures, said ceramic coating will intumesce.

* * * * *